United States Patent [19]

Santostasi et al.

[11] Patent Number: 4,534,480

[45] Date of Patent: Aug. 13, 1985

[54] TAMPER EVIDENT CLOSURE

[75] Inventors: Paul A. Santostasi; Herbert V. Dutt, both of Sarasota; Arno F. Pirkau, Bradenton, all of Fla.

[73] Assignee: Sun Coast Plastics, Inc., Sarasota, Fla.

[21] Appl. No.: 616,108

[22] Filed: Jun. 1, 1984

[51] Int. Cl.[3] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 2,140,732 | 12/1938 | Burke | 215/251 |
| 3,310,191 | 3/1967 | Kern et al. | 215/252 |
| 3,407,976 | 10/1968 | Homma | 215/250 X |
| 3,415,403 | 12/1968 | Bardell | 215/252 |
| 3,504,818 | 4/1970 | Crisci | 215/252 |
| 3,650,428 | 3/1972 | Miller | 215/252 |
| 3,812,994 | 5/1974 | Feldman | 215/256 |
| 3,871,545 | 3/1975 | Bereziat | 215/256 X |
| 3,901,403 | 8/1975 | Menke | 215/258 |
| 4,225,050 | 9/1980 | Reinhart | 215/252 |
| 4,337,870 | 7/1982 | Keeler | 215/252 |

*Primary Examiner*—Donald F. Norton

*Attorney, Agent, or Firm*—Jones, Tullar & Cooper

[57] ABSTRACT

A tamper evident closure preferably for use on a screw threaded neck of a container is disclosed. The closure includes a tamper evident band which is quite thin and has a diameter which approximates that of the cap's sidewall. The tamper evident band is joined to the cap's sidewall by a plurality of bridge strips that are circumferentially aligned with ratchet teeth on the tamper evident band. During application of the cap to the container neck, the band deforms as the ratchet teeth cam over cooperatively shaped ratchet lugs on the bottle neck. However, during cap removal, the ratchet lugs stop the ratchet teeth and the tamper evident band from moving so that the band is separated from the cap thereby providing a clear indication of tampering with the closure.

5 Claims, 5 Drawing Figures

TAMPER EVIDENT CLOSURE

FIELD OF THE INVENTION

The present invention is directed generally to a tamper evident closure for a container. More particularly, the present invention is directed to a tamper evident closure in which a tamper evident ring or band stays with the container. Most specifically, the present invention is directed to a tamper evident closure whose tamper evident ring is provided with inwardly directed ratchet teeth. These ratchet teeth may be equally spaced around the inner peripheral surface of the tamper evident ring and are generally triangular in cross-sectional shape. The container, such as a bottle, to which the closure is applied, has outwardly projecting ratchet lugs formed on the outer surface of the container with these lugs being shaped to allow the ratchet teeth on the closure to slide over them during closure application. When the closure is removed, the ratchet teeth are stopped by the lugs on the container, thereby causing rupture of the connector or bridge strips which join the tamper evident ring to the container. These bridge strips, which are circumferentially aligned with, and are formed as extensions of the ratchet teeth on the tamper evident ring, have a reduced thickness at their point of attachment to the body of the closure thereby facilitating breakage of the bridge strips when the closure is removed. The tamper evident band or ring is quite thin and has an outer diameter which is generally no greater than the outer diameter of the sidewall portion of the closure cap.

DESCRIPTION OF THE PRIOR ART

The use of tamper evident closures with numerous consumer goods that are typically packaged in bottles and similar containers is well known in the art. All of these tamper evident means are intended to indicate whether or not the closure has been removed from the container, and the contents possibly adulterated or tampered with since the container was filled by the manufacture. Thus the consumer can buy and use the products with the assurance that they are in the same condition as when they left the manufacturer. The consumer need not fear that the contents of the container have been altered in any way so long as the tamper evident closure is intact.

The tamper evident closure must be highly effective and dependable if it is to fulfill its mission of assuring the consumer that his goods have not been tampered with. To provide this assurance, it is paramount that the tamper evident means work consistantly and that it be foolproof so that the closure cannot be removed without having the tamper evident means operate.

The seller of the goods, in addition to having the consumer's expectations in mind, also has criteria of his own. These include ease of application of the closure to the container, low cost of the closure, and attractiveness or overall visual impact and appeal of the closure. In a number of the prior art closures, these two sets of expectation and criteria have been, if not mutually exclusive, then at least difficult the attain. A closure which is satisfactory from a consumer safety standpoint based on reliability of tamper evidence may be difficult to manufacture or apply to the container and hence not be particularly favorably received by the packager or manufacturer.

One type of tamper evident closure which is generally known in the art is comprised of a screw threaded closure cap and a tamper evident ring which is positioned beneath the lower portion of the sidewall of the screw cap and which is attached thereto by a plurality of bridge strips. The tamper evident ring has several inwardly extending ratchet teeth formed on its inner peripherial surface. These ratchet teeth cooperate with suitably shaped outwardly extending lugs that are formed on the outer surface of the neck of the container to which the closure is to be attached. Exemplary of patents showing such a structure are U.S. Pat. No. 3,504,818 to Crisci et al and U.S. Pat. No. 4,337,870 to Keeler. In the Crisci patent, which may be viewed as typical of this general category of patents, the ratchet teeth on the tamper evident ring and the bridge strips which join the ring to the container body are circumferentially offset from each other. This offset spacing is set forth in the Crisci patent as being important to provide sufficient flexibility of the tamper evident ring to allow the ring to distort as the ratchet teeth are cammed over the cooperating lugs on the container.

Offset placement of the bridge strips and ratchet teeth, while allowing the ring to flex with respect to the container cap, has several less desirable aspects. Closure caps and tamper evident rings are usually molded from plastic as one unit. Thus, it is necessary for the mold to be suitably structured to allow the liquid plastic to flow into the portion of the mold where the tamper evident ring is to be formed. Such flow passages must either be through the bridge strips or through auxiliary passages. Offsetting of the bridge strips from the ratchet teeth makes the plastic flow path more complex and hence increases the number of defective parts molded. The use of auxiliary flow paths to the tamper evident ring increases the complexity of the mold and reduces the appearance of the finished product since there are invariably rough edges or the like where the molded article is removed from and separated from the auxiliary flow passage.

The flexibility required to insure that the tamper evident ring will deform as the teeth cam over the cooperating lugs during closure application must not be so great that the teeth can ride over the lugs during closure removal. In the prior art this requisite stiffness for proper ring separation during closure removal has dictated the use of a relatively thick tamper evident ring whose flexibility during application has been provided by the offset or staggered placement of the ratchet teeth and the bridge strips. However, a thick ring is relatively unattractive and has not been well received by container manufacturers and others concerned with the overall appearance of the package. The band thickness has also dictated a band placement set radially outwardly from the sidewall of the closure cap. Such a band placement again interferes with the shape and appearance of the overall package and as such is not particularly well received by product marketing and sales personnel.

The tamper evident closures which are presently available and which depend on the cooperation of ratchet teeth on the tamper indicating ring with lugs on the bottle for separation of the ring from the closure cap are somewhat difficult to mold, have depended on an offset bridge strip placement for ring to cap connection, and have been relatively thick and somewhat bulky in appearance. These factors have contributed to less of an acceptance of this type of tamper evident closure than would be expected based on the positive aspects of this type of closure.

SUMMARY OF THE INVENTION

It is an object of the present invention to provide a tamper evident closure.

Another object of the present invention is to provide a screw threaded tamper evident closure.

A further object of the present invention is to provide a tamper evident closure of the ratchet toothed type.

Yet another object of the present invention is to provide a tamper evident closure having a thin, flexible tamper evident ring.

Still a further object of the present invention is to provide a tamper evident closure whose tamper evident ring has an outer diameter which is generally no greater than the approximate outer diameter of the sidewall of the closure cap.

Still yet another object of the present invention is to provide a tamper evident closure in which the bridge strips and ratchet teeth are circumferentially aligned.

As will be presented in greater detail in the description of the preferred embodiment which is set forth hereinafter, the tamper evident closure in accordance with the present invention is of the screw threaded type and is provided with a tamper evident ring. This ring is joined to the lowermost portion of the sidewall of the closure cap by a plurality of circumferentially spaced bridge or connector strips. Each of these strips extends along the inner peripherial surface of the tamper evident ring in a direction generally perpendicular to the ring's radial plane and becomes a ratchet tooth. The tamper evident ring has several such ratchet teeth spaced about its inner circumference and these teeth cooperate with outwardly extending lugs carried by the neck of the container. During closure application, the ratchet teeth cam over the bottle lugs. During closure removal, the ratchet teeth engage the lugs and prevent the ring from turning with the closure. The ring thus separates from the closure and stays with the bottle to thereby indicate the possibility that the contents of the bottle have been tampered with.

The tamper evident closure in accordance with the present invention can be molded in a simple and straight forward manner in a straight ejection mold. No side slide mold is required as has often been the case with prior art devices. The closure cap and tamper evident ring are joined to each other by the several circumferentially spaced bridge strips in a generally known manner. However, in the closure in accordance with the present invention, the bridge strips and ratchet teeth carried by the tamper evident ring are circumferentially aligned. In fact, the bridge strips become the ratchet teeth once they have extended to the tamper evident ring. Thus the bridge strips can act as flow paths for the plastic material during molding of the closures and allow the molding to proceed in an uncomplicated manner. No auxiliary flow paths are required. The uncomplex molding process reduces both molding costs and time thereby reducing unit costs.

The placement of the bridge strips and ratchet teeth in circumferential alignment has the advantage of providing a stiffer ring at this point to prevent stripping of the ratchet teeth over the bottle lugs during closure removal. This placement also allows the use of a thin tamper evident ring or band which is quite flexible thereby facilitating easy installation. As the closure and attached tamper evident ring are placed on the container and screwed down, the ratchet teeth cam over the container lugs. The tamper evident ring is sufficiently thin and flexible that it can distort during closure attachment without rupturing or breaking. In contrast with prior art rings, which were thicker and depended on flexure of the bridge strips which were staggered circumferential from the ratchet teeth to allow sufficient ring flexure for installation, the thin ring in accordance with the present invention is sufficiently flexible so that the bridge strips and ratchet teeth can be aligned. During closure removal, the ratchet teeth engage the container lugs in a generally well known manner. The bridge strips break from the closure sidewall and the cap can be removed while leaving the separated ring as evidence of the opening. With the thin ring in accordance with the present invention, the circumferentially aligned bridge strips and ratchet teeth are sufficiently strong that the band does not bow out thus insuring that the ratchet teeth firmly engage the container lugs for positive, dependable separation of the tamper evident ring from the closure. If the band were made thin in accordance with the present invention, but with the ratchet teeth and bridge strip circumferentially staggered in accordance with the prior art devices, there would be a substantial chance that the ring would deflect at the ratchet teeth thereby allowing the teeth on the tamper evident ring to deflect outwardly over the lugs on the bottle. However, the alignment of the bridge strips and ratchet teeth allows the use of a thin, flexible band which tends to straighten between teeth during cover application for ease of cover securement while maintaining sufficient stiffness to allow separation of the ring or band from the closure cap during removal of the closure.

The tamper evident band in accordance with the present invention is, as was indicated previously, thinner than prior art devices. This reduced band thickness allows the band to be located within the outer diameter of the sidewall of the closure cap. The entire band assembly, including the ratchet teeth, has a thickness generally no greater than that of the lower skirt portion of the sidewall of the closure cap. This reduced thickness, in comparison to prior art devices, provides a much more pleasing overall appearance for the closure and ring. The assembly is sleek and trim looking and does not detract from the appearance of the container. No bumps or protrusions are presented by the assembly so that the neck of the container does not appear unattractive. In addition, the thin shape and uniform sidewall means that there are no edges sticking out from the bottle neck to interfere with packaging, additional labeling, or the like. The thin, trim shape enhances the overall appearance of the package and renders it aesthetically more appealing. Since the package looks appealing, it is more apt to be purchased than one that is less attractive. Thus the seller whose goods are in a container provided with a tamper evident closure in accordance with the present invention will be pleased with consumer acceptance of his product and with the tamper evident closure itself.

The tamper evident closure in accordance with the present invention is less difficult to mold than prior devices, allows easy installation yet cannot be removed without separation of the ring from the closure cap, and is sufficently thin to present a sleek, trim profile. Thus it will be seen that the tamper evident closure in accordance with the subject invention represents a substantially better and more effective closure assembly than prior art devices.

BRIEF DESCRIPTION OF THE DRAWINGS

While the novel features of the tamper evident closure in accordance with the present invention are set forth with particularity in the appended claims, a full and complete understanding of the invention may be had by referring to the description of a preferred embodiment, as set forth hereinafter and as may be seen in the accompanying drawings in which:

DESCRIPTION OF THE PREFERRED EMBODIMENT

Figure 1:
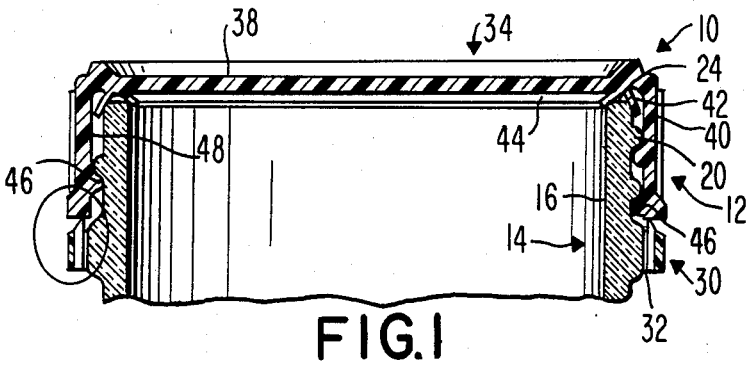
FIG. 1 is a sectional side elevational view of a tamper evident closure and container in accordance with the present invention.

Turning initially to FIG. 1, there may be seen a closure arrangement generally at 10 comprised of a tamper evident closure, generally at 12 secured to an open mouthed container, generally at 14. While container 14 will be discussed hereinafter in terms of a bottle having a reduced diameter neck portion 16, it will be obvious to one of skill in the art that the closure 12 could be equally well suited for use with other containers.

Figure 4:
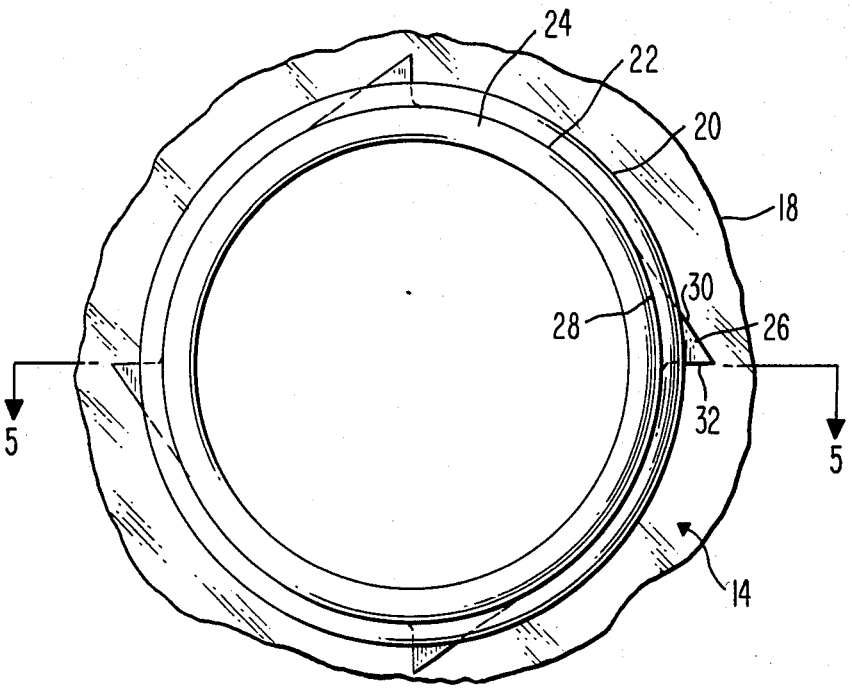
FIG. 4 is a top plan view of a container neck portion structured for use with the closure in accordance with the present invention.
Figure 5:
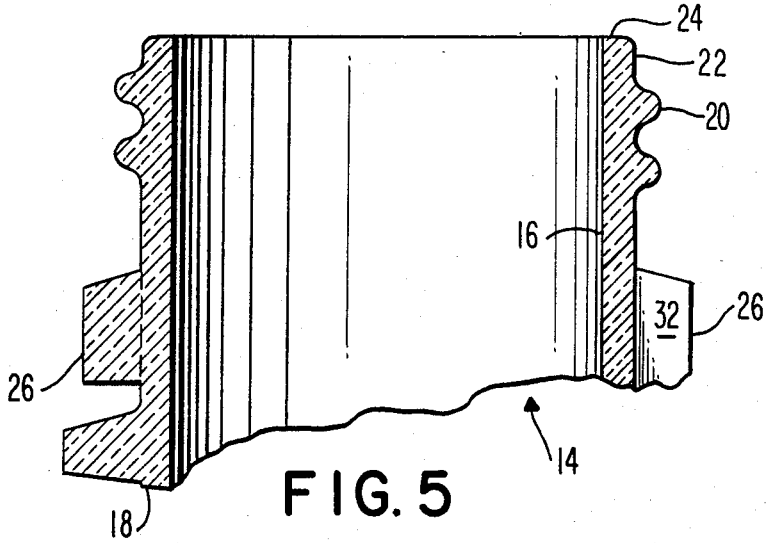
FIG. 5 is a sectional side elevation view of the container of FIG. 4 taken along line 5—5 of FIG. 4.

As seen more clearly in FIGS. 4 and 5, container 14 is a bottle or the like which has a reduced diameter neck portion 16 that extends upwardly from the body 18 of the bottle or other similar container. Neck 16 is typically circular in cross-section, as seen in FIG. 4 and is provided with generally conventional helical screw threads 20 that extend about the outer circumferential surface 22 of neck 16. Neck 16 terminates in a flat upper surface 24 in a conventional manner. A plurality of ratchet lugs 26 are formed on the outer surface 22 of container neck 16 below the level of the lowest screw thread 20 and above the body 18 of the container. The number of these lugs 26 is variable but typically ranges between four and eight. The lugs 26 are typically equally spaced about the circumferenie of the outer surface 22 of the neck 16, as may be seen in FIG. 4 but again this spacing and positioning may be varied.

Each ratchet lug 26 is generally in the shape of a right triangle as seen in a plan view such as FIG. 4. The base 28 of each of the triangular lugs 26 is formed integrally with the neck 16 of container 14. The sloped camming surface 30 or hypotenuse of each triangular lug 26 slopes outwardly in the clockwise direction about neck 16, as may be seen in FIG. 4. This slope is intended for use with a conventional right hand threaded closure 12 which is rotated in a clockwise direction about neck 16 to secure the closure 12 to neck 14. If a left hand threaded closure were being used, the slope of the lugs 26 would have to be reversed. A flat ratchet lug face 32 forms the third side of the right triangle with flat face 32 extending radially outwardly from the outer surface 22 of neck 16 generally perpendicular to triangle base 28. While it will be understood that flat lug face 32 is generally perpendicular to base portion 28 a variance of a few degrees will be acceptable so long as face 32 is essentially flat and generally perpendicular to neck 16.

Referring again to FIGS. 1–3 a tamper evident closure generally at 12 in accordance with the present invention is seen secured to the neck 16 of container 14. Tamper evident closure 12 includes a closure cap generally at 34 and a tamper evident ring or band generally at 36. Both the cap 34 and ring 36 are typically made of molded plastic in a straight ejection molding process. As may be seen in FIGS. 1 and 2, cap 34 is comprised of a generally flat circular top 38 having a downwardly extending annular cylindrical side wall 40. A sealing gasket assembly which includes oppositely angled lips 42 and 44 is provided on the inner surface of closure cap 34 and engages the upper surface 24 of container neck 16. This sealing gasket is set forth more fully in U.S. Pat. No. 4,143,785 which is assigned to a common assignee. Sidewall 40 of closure 34 is formed with helical screw threads 46 molded on the inner surface 48 of sidewall 40. These screw threads 46 are generally conventional and cooperate with threads 20 on container neck 16 to hold the closure cap 34 on the container neck 16 when the cap 34 is rotated in a clockwise direction with respect to the container neck 16.

Figure 3:
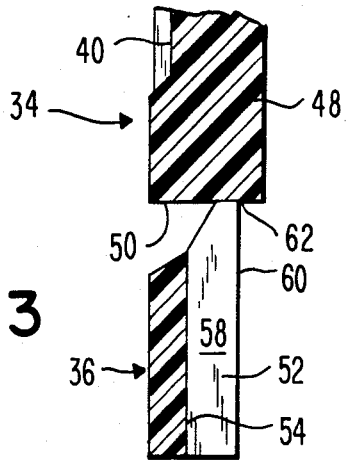
FIG. 3 is an enlarged view of the portion of the sidewall and tamper evident ring portion of the closure encircled in FIG. 1.

Tamper evident band or ring 36 is a generally thin annular ring which is attached beneath a bottom surface 50 of closure sidewall 40, as seen in FIGS. 1 and 3. A plurality of generally right triangular ratchet teeth 52 are formed on the inner surface 54 of tamper evident band 36. These teeth 52 each have a base portion which is coextensive with inner surface 54 of band 36, a camming surface 56 formed as the hypotenuse of the right triangle, and a flat tooth face 58 which extends generally radially inwardly of band or ring 36. Ideally the number and spacing of ratchet teeth 52 is the same as the number of ratchet lugs 26 on the container 14 since these teeth 52 and lugs 26 cooperate when the closure 12 is secured to the container 14.

Each ratchet tooth 52 is joined to the bottom surface 50 of closure cap sidewall 40 by a bridge or connector strip 60. Each bridge strip 60 is somewhat trapezoidal in side elevation view, as seen in FIG. 3, and has a reducing thickness as it extends from the ratchet tooth 52 to its point of connection 62 with the bottom surface 50 of sidewall 40. Point of connection 62 is also the point at which the tamper evident ring 36 separates from the closure cap 34 when the cap is removed.

Several important features of the subject invention should again be noted at this juncture. The tamper evident band 36 may be seen in FIGS. 1–3 as having a thickness, including the ratchet teeth 52, which is generally no greater than the thickness of the sidewall 40 of the closure cap 34. The advantages of such a thin tamper evident band were discussed at some length in a prior portion of the application but it should again be emphasized that this thinness makes a more appealing and pleasing package as well as facilitating packaging, handling, and shipment. The second feature of importance is the circumferential alignment of the ratchet teeth 52 and bridge strip 60. As was also discussed previously, this circumferential alignment is contrary to the circumferentially staggered placement typically shown in the prior art and allows the use of a thin tamper evident band. The thin band will flex sufficiently to allow application of the closure 12 to the container 14 while the alignment of teeth 52 and bridge strips 60 provides sufficient stiffness so that the teeth do not strip during closure removal thereby ensuring breakage of the bridge strips 60 at their weakest point 62. The alignment of ratchet teeth 52 and bridge strips 60 also simplifies the molding process used to form the closure cap and tamper evident ring as the bridge strip 60 also acts as a flow path in the mold for the plastic to flow between the sidewall 40 and the tamper evident ring 36. The direct flow path provided by the alignment of the bridge strips 60 and ratchet teeth 52 insures proper plastic flow to all portions of the mold cavity so that defectively molded parts are reduced to a minimum.

Figure 2:
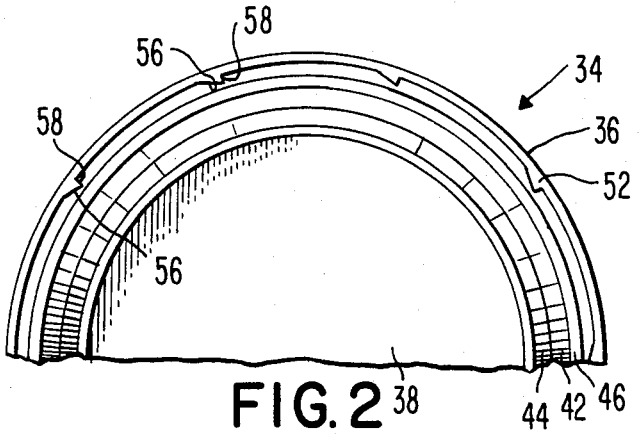
FIG. 2 is a bottom plan view of a portion of the tamper evident closure.

In useage, the closure cap 34 and attached tamper evident band 36 which make up the tamper evident closure 12 in accordance with the present invention, are applied to the open neck portion 16 of container 14 by cooperation of the screw threads 20 on the neck 16 of the container 14 with the screw threads 46 on the sidewall 40 of the closure cap 34. As may be seen in FIG. 1, as the cap 34 is screwed down onto the container neck 16 until the seal lips 42 and 44 engage the neck's upper surface 24, the ratchet teeth 52 on the tamper evident band 36 are brought into position in contact with the ratchet lugs 26 on the container neck 16. Referring to FIGS. 2 and 4 and recalling FIG. 2 is a bottom plan view, it will be seen that the camming surfaces 30 and 56 of ratchet lugs 26 and ratchet teeth 52, respectively are cooperatively shaped so that the sloped surfaces 56 of teeth 52 will slide up and over the sloped surfaces 30 of ratchet lugs 26 during clockwise rotation of tamper evident closure 12 on neck 16 of container 14. Such sliding will effectively increase the diameter of the tamper evident band 36 at the points of tooth and lug contact but this will be accomodated for by the straightening of the band portions between ratchet teeth. Once the closure cap 34 has been secured to the neck 16 of container 14, it cannot be removed without separating the tamper evident band 36 from the cap's sidewall 40. As the cap is twisted in a counterclockwise direction during removal, the flat ratchet tooth face 58 is turned into engagement with the flat ratchet lug face 32. The ratchet teeth 52 are sufficiently rigid and the respective faces 58 and 32 are sufficiently flat that the tamper evident band 36 will not flex outwardly so that the teeth cannot slip thereby causing the bridge strips 60 to break at their point of least resistance; i.e., their connection points 62. Once the bridge strips 60 have broken, the cap may be unscrewed. However, now there is clear evidence that the cap has been removed since the tamper evident band has been separated from the rest of the closure. Whether the tamper evident band is removed from the neck of the container or is left thereon, it is obvious to even a casual observer that the closure has been removed, or at least loosened. Thus the tamper evident closure in accordance with the present invention provides a closure which insures consumer safety and which is also attractive and easy to handle and package due to the thinness of the tamper evident band while being highly reliable in operation yet easy to mold due to the circumferential alignment of the bridge strips and ratchet teeth.

While a preferred embodiment of a tamper evident closure in accordance with the present invention has been set forth fully and completely hereinabove, it will be obvious to one of skill in the art that a number of changes in, for example, the materials used for the closure, the number and placement of the ratchet teeth and ratchet lugs, the type of screw threads and the like could be made without departing from the true spirit and scope of the invention which is accordingly to be limited only by the following claims.

We claim:

1. A tamper evident closure for a container having an open mouth which is closed by the closure, said tamper evident closure comprising:

a closure cap having a generally circular top and a generally cylindrical sidewall extending downwardly from said top, said sidewall including interior screw threads which cooperate with exterior screw threads on the container to secure said closure cap to the container;

a tamper evident band secured by a plurality of spaced bridge strips to a bottom surface of said sidewall, said tamper evident band having an outer diameter generally the same as an outer diameter of said sidewall and a thickness equal to or less than a thickness of said sidewall; and a plurality of spaced ratchet teeth formed on an inner surface of said tamper evident band and being circumferentially aligned with said bridge strips, said ratchet teeth cooperating with ratchet lugs on the container to cause said tamper evident band to become separated from said sidewall of said cap when said cap is removed from the container.

2. The tamper evident closure of claim 1 wherein each of said ratchet teeth is generally in the shape of a right triangle.

3. The tamper evident closure of claim 1 wherein each of said bridge strips is of reducing thickness in the direction of said bottom surface of said sidewall.

4. The tamper evident closure of claim 1 wherein each of said bridge strips is forced as a continuation of one of said ratchet teeth and extends from an upper portion of its one of said ratchet teeth to said bottom surface of said sidewall.

5. The tamper evident closure of claim 1 wherein there are an equal number of said ratchet teeth and said ratchet lugs.

* * * * *